US006732639B1

(12) United States Patent
Daniels

(10) Patent No.: US 6,732,639 B1
(45) Date of Patent: May 11, 2004

(54) STENCILING ASSEMBLY

(75) Inventor: Shawn B. Daniels, 678 Cleveland Dr., Cheektowaga, NY (US) 14225

(73) Assignee: Shawn B. Daniels, Cheektowaga, NY (US)

( * ) Notice: Subject to any disclaimer, the term of this patent is extended or adjusted under 35 U.S.C. 154(b) by 0 days.

(21) Appl. No.: 10/308,271

(22) Filed: Dec. 4, 2002

(51) Int. Cl.[7] ..... B05C 17/06

(52) U.S. Cl. ..... 101/127; 101/127.1; 33/565; 434/87

(58) Field of Search ..... 101/114, 127, 101/127.1, 128; 2/206; 132/216, 319; 434/87; 33/565, 566

(56) References Cited

U.S. PATENT DOCUMENTS 1,205,386 A * 11/1916 Perenyl et al. ..... 446/87
1,708,968 A * 4/1929 Gianelloni, Jr. ..... 101/128
1,947,442 A * 2/1934 Baker ..... 62/255
2,435,516 A * 2/1948 Samson ..... 132/216
3,778,910 A * 12/1973 Smalligan ..... 434/164
4,135,840 A 1/1979 Puccini et al.
4,231,677 A 11/1980 Roming
4,242,802 A * 1/1981 Jenner et al. ..... 434/87
4,610,096 A * 9/1986 Sahler et al. ..... 33/565
4,776,723 A 10/1988 Brimo
5,061,172 A 10/1991 Fennessy, Sr.
5,186,190 A * 2/1993 Hirzel ..... 132/319
5,203,706 A * 4/1993 Zamir ..... 434/172
5,243,905 A 9/1993 Webber
5,396,713 A * 3/1995 Valdez ..... 33/565
D426,915 S 6/2000 Davis, Jr.

* cited by examiner

*Primary Examiner*—Ren Yan
(74) *Attorney, Agent, or Firm*—David A. Lockbeck

(57) ABSTRACT

A stenciling assembly for connecting and interlocking stencil members together end-to-end. The stenciling assembly includes one or more stencil members each including a piece of material having a distinctive pattern and being used to transpose the pattern onto other objects; and also includes one or more first connector members each being attached to a first end of a respective stencil member for connecting the stencil member to other stencil members; and further includes one or more second connector members being attached to a second end of a respective stencil member for connecting the stencil member to other stencil members.

4 Claims, 4 Drawing Sheets

STENCILING ASSEMBLY

BACKGROUND OF THE INVENTION

1. Field of the Invention

The present invention relates to stencils and more particularly pertains to a new stenciling assembly for connecting and interlocking stencil members together end-to-end.

2. Description of the Prior Art

The use of stencils is known in the prior art. More specifically, stencils heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,243,905; U.S. Pat. No. 4,135,840; U.S. Pat. No. 4,231,677; U.S. Pat. No. 5,061,172; U.S. Pat. No. 4,776,623; and U.S. Pat. No. Des. 426,915.

While these devices fulfill their respective, particular objectives and requirements, the aforementioned patents do not disclose a new stenciling assembly. The prior art includes stencils made of mats which are used to create designs upon selected surfaces.

SUMMARY OF THE INVENTION

The general purpose of the present invention, which will be described subsequently in greater detail, is to provide a new stenciling assembly which has many of the advantages of the stencils mentioned heretofore and many novel features that result in a new stenciling assembly which is not anticipated, rendered obvious, suggested, or even implied by any of the prior art stencils, either alone or in any combination thereof. The present invention includes one or more stencil members each including a piece of material having a distinctive pattern and being used to transpose the pattern onto other objects; and also includes one or more first connector members each being attached to a first end of a respective stencil member for connecting the stencil member to other stencil members; and further includes one or more second connector members being attached to a second end of a respective stencil member for connecting the stencil member to other stencil members. None of the prior art includes the combination of the elements of the present invention.

There has thus been outlined, rather broadly, the more important features of the stenciling assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new stenciling assembly which has many of the advantages of the stencils mentioned heretofore and many novel features that result in a new stenciling assembly which is not anticipated, rendered obvious, suggested, or even implied by any of the prior art stencils, either alone or in any combination thereof.

Still another object of the present invention is to provide a new stenciling assembly for connecting and interlocking stencil members together end-to-end.

Still yet another object of the present invention is to provide a new stenciling assembly that is easy and convenient to set up and use.

Even still another object of the present invention is to provide a new stenciling assembly that allows the user to easily connect and disconnect a series of stencil members together for transposing an array of patterns upon various objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
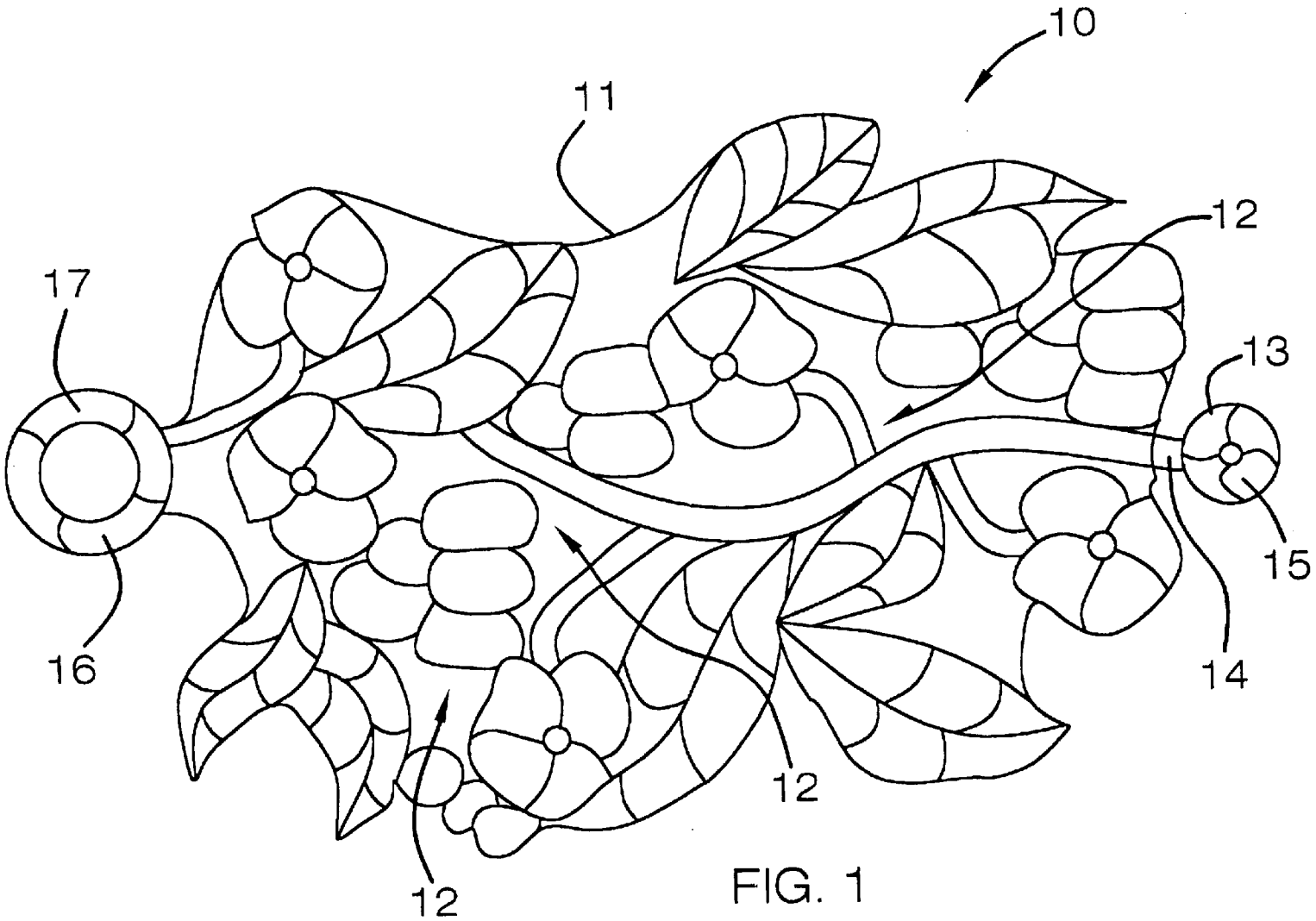
FIG. 1 is a front elevational view of one stencil member of a new stenciling assembly according to the present invention.
Figure 2:
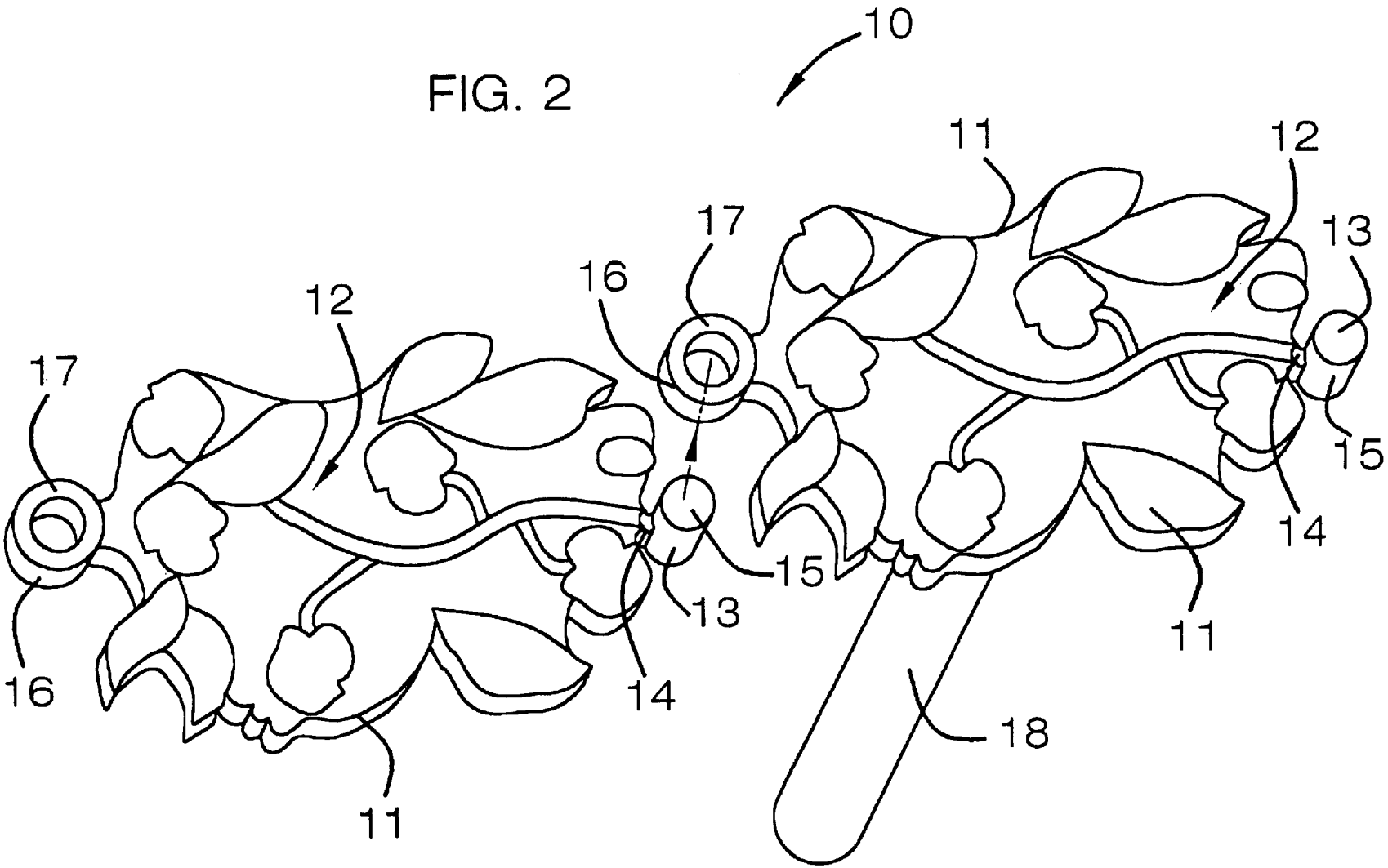
FIG. 2 is an exploded perspective view of two stencil members of the present invention.
Figure 3:
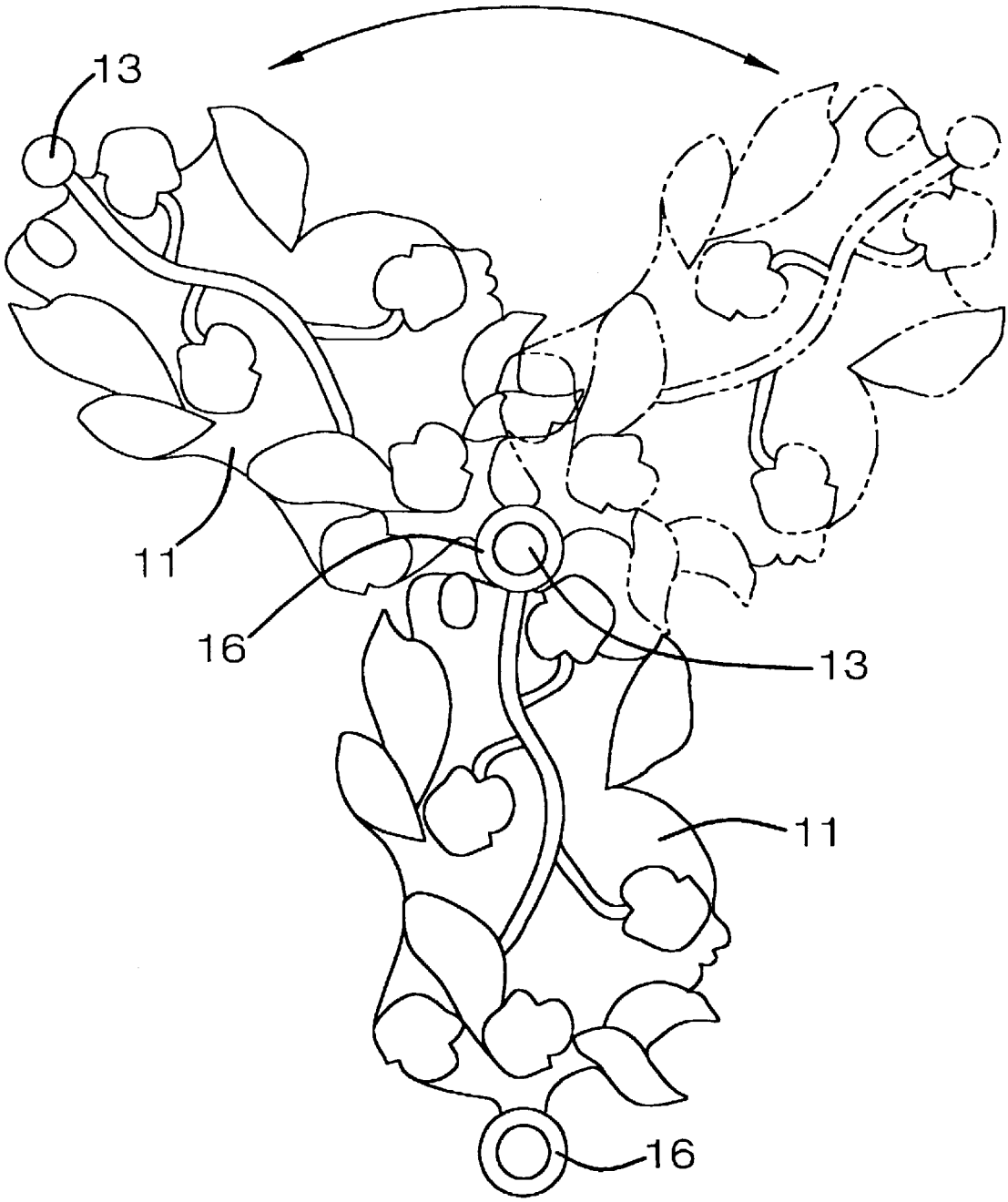
FIG. 3 is a front elevational view of two stencil members of the present invention.
Figure 5:
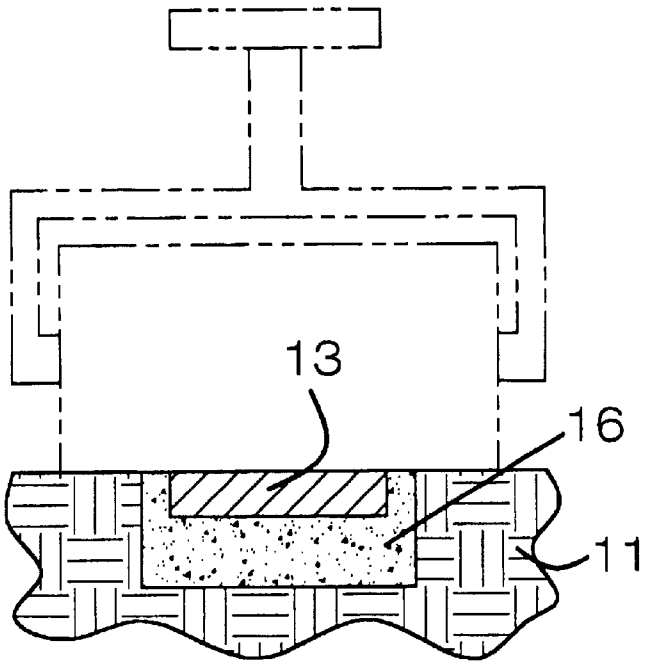
FIG. 5 is a cross-sectional view of the present invention.
Figure 4:
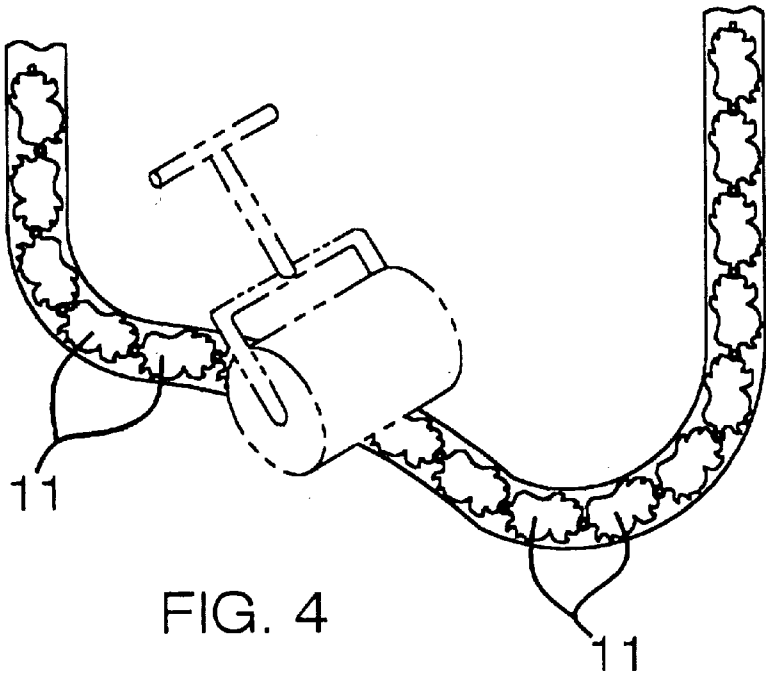
FIG. 4 is a perspective view of interlocked stencil members of the present invention.

With reference now to the drawings, and in particular to FIGS. 1 through 5 thereof, a new stenciling assembly embodying the principles and concepts of the present invention and generally designated by the reference numeral 10 will be described.

As best illustrated in FIGS. 1 through 5, the stenciling assembly 10 generally comprises one or more stencil members 11 each including a piece of material having a distinctive pattern and being used to transpose the pattern onto other objects. The piece of material has a plurality of openings 12 being disposed therethrough with the openings 12 being arranged to form the pattern. The piece of material has a distinctive shape with irregular-shaped edges.

One or more first connector members 13 each being conventionally attached to a first end of a respective stencil member 11 for connecting the stencil member 11 to other stencil members. Each first connector member 13 is pivotally and conventionally attached to the first end of a respective stencil member 11 and includes a flexible stem 14 being bendably attached to the stencil member 11 and also includes a cylindrical member 15 being conventionally attached to the flexible stem 14. The flexible stem 14 has an end that is attached to a side wall of the cylindrical member 15 and extends outwardly generally perpendicular to a longitudinal axis of the cylindrical member 15.

One or more second connector members 16 each being conventionally attached to a second end of a respective stencil member 11 for connecting the stencil member 11 to other stencil members. Each second connector member 16 includes an eyelet 17 being conventionally attached to the second end of a respective stencil member 11 and removably receiving the cylindrical member 15 of another stencil member therein and therethrough to effectively connect the stencil members together end-to-end.

As a second embodiment, the stenciling assembly includes one or more elongate handle members 18 each being conventionally attached to a side of a respective stencil member 11 for manipulating the stencil member 11 as desired by the user.

In use, the user connects the particular stencil members 11 together using the first and second connector members 13,16 and places the connected stencil members 11 upon a particular surface to which the user desires to transpose the design or pattern of the stencil members 11 to the particular surface. The first and second connector members 13,16 allows the user to twist and bend the stencil members 11 relative to one another to position the stencil members 11 as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the stenciling assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stenciling assembly comprising:

one or more stencil members each including a piece of material having a distinctive pattern and being used to transpose said pattern onto other objects, said piece of material having a plurality of openings being disposed therethrough with said openings being arranged to form said pattern, said piece of material having a distinctive shape with irregular-shaped edges;

one or more first connector members each being attached to a first end of a respective said stencil member for connecting said stencil member to other stencil members, said first connector member being pivotally attached to said first end of a respective said stencil member and including a flexible stem being attached to said stencil member and also including a cylindrical member being attached to said flexible stem; and one or more second connector members being attached to a second end of a respective said stencil member for connecting said stencil member to other stencil members.

2. A stenciling assembly as described in claim 1, wherein said flexible stem has an end that is attached to a side wall of said cylindrical member and extends outwardly generally perpendicular to a longitudinal axis of said cylindrical member.

3. A stenciling assembly as described in claim 2, wherein said second connector member includes an eyelet being attached to said second end of a respective said stencil member and removably receiving said cylindrical member of another said stencil member therein and therethrough to effectively connect said stencil members together end-to-end.

4. A stenciling assembly as described in claim 3 also includes one or more elongate handle members each being conventionally attached to a side of a respective said stencil member for manipulating said stencil member as desired by the user.

* * * * *